US011952846B2

(12) United States Patent
Alsheikh et al.

(10) Patent No.: US 11,952,846 B2
(45) Date of Patent: Apr. 9, 2024

(54) ROTATIONAL CONTINUOUS CIRCULATION SYSTEM

(71) Applicants: SAUDI ARABIAN OIL COMPANY, Dhahran (SA); Kasab International Energy Services Co. Ltd., Al Khobar (SA)

(72) Inventors: Mohammed Alsheikh, Dhahran (SA); Mohammed Aljubran, Dhahran (SA); Abdulwahab Aljohar, Dhahran (SA); Ossama Ramzi Sehsah, Dhahran (SA); Meshari Alshalan, Al Khobar (SA); Chinthaka Pasan Gooneratne, Dhahran (SA); Abdulkareem Saqqa, Al Khobar (SA); Amjad Alshaarawi, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/081,408

(22) Filed: Dec. 14, 2022

(65) Prior Publication Data

US 2023/0193708 A1 Jun. 22, 2023

Related U.S. Application Data

(60) Provisional application No. 63/290,124, filed on Dec. 16, 2021.

(51) Int. Cl.
*E21B 21/10* (2006.01)
*E21B 21/01* (2006.01)

(52) U.S. Cl.
CPC ..... *E21B 21/10* (2013.01); *E21B 21/01* (2013.01)

(58) Field of Classification Search
CPC ..... E21B 21/10; E21B 21/019; E21B 21/02; E21B 17/05
See application file for complete search history.

(56) References Cited

U.S. PATENT DOCUMENTS 6,688,394 B1 2/2004 Ayling
7,533,720 B2 * 5/2009 Robichaux ..... E21B 21/02 166/84.1

(Continued)

OTHER PUBLICATIONS

Johnson et al., "New Method for Enhanced Continuous Circulation Automation", SPE/IADC-189999-MS, Apr. 2018.

*Primary Examiner* — Kenneth L Thompson
(74) *Attorney, Agent, or Firm* — Bracewell LLP; Constance G. Rhebergen; Keith R. Derrington

(57) ABSTRACT

A rotational continuous circulation system and methods includes a circulation sub having an internal bore extending along a central axis. The circulation sub has an uphole body having a reduced outer diameter along a downhole length of the uphole body. A central valve selectively opens and closes the uphole internal bore. At least one check valve is located within a sidewall of the uphole body to selectively allow fluid to flow into the uphole internal bore through the at least one check valve. A downhole body has an uphole portion circumscribing a downhole portion of the uphole body. A sleeve assembly circumscribes the reduced outer diameter of the uphole body. The uphole body and the downhole body are configured to rotate about the central axis independently from the sleeve assembly. A side-entry port of the sleeve assembly provides a fluid flow path from an exterior of the sleeve assembly to the at least one check valve.

24 Claims, 7 Drawing Sheets

(56) References Cited

U.S. PATENT DOCUMENTS

| | | | | |
|---|---|---|---|---|
| 7,726,418 | B2 | 6/2010 | Ayling | |
| 8,627,890 | B2 * | 1/2014 | Bailey | E21B 7/00 175/218 |
| 8,826,992 | B2 | 9/2014 | Zhou | |
| 9,151,124 | B2 | 10/2015 | Iblings et al. | |
| 9,353,587 | B2 | 5/2016 | Bansal et al. | |
| 9,371,708 | B2 * | 6/2016 | Weir | E21B 33/068 |
| 10,006,262 | B2 | 6/2018 | Bansal et al. | |
| 10,533,389 | B2 * | 1/2020 | Peveri | E21B 21/106 |
| 10,655,410 | B2 | 5/2020 | Johnson et al. | |
| 10,794,130 | B2 * | 10/2020 | Johnson | E21B 21/08 |
| 11,530,753 | B1 * | 12/2022 | Yang | F16K 11/105 |
| 11,725,480 | B2 * | 8/2023 | Thomson | E21B 37/00 166/312 |
| 2021/0246739 | A1 | 8/2021 | Alshaarawi et al. | |

* cited by examiner

ROTATIONAL CONTINUOUS CIRCULATION SYSTEM

CROSS REFERENCE TO RELATED APPLICATION

This application claims priority to and the benefit of U.S. Provisional Application Ser. No. 63/290,124, filed Dec. 16, 2021, titled "Rotational Continuous Circulation System," the full disclosure of which is hereby incorporated herein by reference in its entirety for all purposes.

BACKGROUND OF THE DISCLOSURE

1. Field of the Disclosure

The present disclosure relates in general to making up and breaking out pipe connections during drilling operations and, in particular, to a tool for allowing circulation of fluid through and rotation of a pipe string while making up or breaking out pipe connections.

2. Description of Related Art

In conventional drilling operations, well bores are drilled with a drill bit on the end of a pipe string that is rotated by means of a rotary table or a top drive. The top drive is coupled to the upper end of the pipe string and provides the necessary torque to rotate the drill bit for continued drilling. Typically, a pump circulates drilling mud through the top drive and down the pipe string to the drill bit during drilling operations. Continued pumping through the top drive forces the drilling mud at the bottom of the wellbore back up the wellbore on the outside of the pipe string, where the drilling mud returns to a drilling mud tank system. The circulating drilling mud cools and cleans the drill bit, bringing the debris and cuttings produced by the drilling process to the surface of the wellbore. Continued drilling draws the pipe string further into the wellbore, eventually requiring another stand of pipe to be added to the pipe string.

Circulation of the drilling mud is significant because: the mud carries cuttings to the surface; the mud applies hydrostatic pressure on the walls of the well to prevent the wellbore walls from collapsing when uncased and prevent hydrocarbons and other undesired fluids from flowing up to the surface, which can be referred to as a blowout; the mud lubricates and cools down the drilling bit during drilling, and prevents the drilling bit and other tools from wear and washout; and the mud forms a thin layer on the wellbore's walls that is called a filter cake that seals formation openings that are natural or penetrated by the drilling bit.

SUMMARY OF THE DISCLOSURE

In some current drilling methods, when a new stand is added to or removed from the pipe string, rotation of the pipe string, and thus drilling, must cease for the entire duration of the period needed to complete the new joint make up. Prolonged periods without rotation causes prolonged static contact between the formation surrounding the pipe string and the pipe string. This static contact increases the risk of the pipe string becoming stuck in the wellbore. A stuck pipe string causes significant problems for the drilling operation that must be overcome at great expense of time and money.

Circulation of the drilling mud through the pipe string must also cease for the entire duration of the period needed to add a stand to or remove a stand from the pipe string.

When circulation of drilling mud stops, the pressure on the wellbore can significantly decrease. This can cause sections of the wellbore to cave in or allow the higher pressure of the surrounding formation to cause a blowout. Particularly in a blowout event, this can cause significant risk to property and life. In addition, the cuttings or other debris produced by the drilling process that are carried up and out of the wellbore by the drilling mud may settle when circulation stops, binding the drill bit or causing the pipe string to become stuck. As noted, a bound drill bit or stuck pipe string can cause significant problems for the drilling operation that must be overcome at great expense of time and money.

Some current systems that provide for limited time periods required for stopping the rotation and stopping the circulation of drilling mud require a long connection time, which can add significant costs to the development operations.

Systems and methods of the current disclosure provide a continuous circulation and rotation system that is operated by minimum steps and requires minimum connection time. The rotational continuous circulation system includes a diversion manifold, a clamp, and a set of circulation subs with side-entry ports.

In an embodiment of this disclosure, a rotational continuous circulation system for connection into a drill pipe string includes a circulation sub having an internal bore extending along a central axis. The circulation sub has an uphole connector end and a downhole connector end for connection in-line with stands of a drill pipe string. An uphole body is a tubular member with an uphole internal bore. The uphole body has a first outer diameter along an uphole length of the uphole body and has a reduced outer diameter along a downhole length of the uphole body. A central valve is located within the uphole internal bore and is operable to selectively open and close the uphole internal bore. A least one check valve is located within a sidewall of the uphole body and is operable to selectively allow fluid to flow into the uphole internal bore through the at least one check valve. A downhole body is a tubular member with a downhole internal bore. An uphole portion of the downhole body circumscribing a downhole portion of the uphole body. A sleeve assembly circumscribes the reduced outer diameter of the uphole body. The uphole body and the downhole body are configured to rotate about the central axis free of relative rotation between the uphole body and the downhole body. The uphole body and the downhole body are configured to rotate about the central axis independently from the sleeve assembly. A side-entry port of the sleeve assembly is operable to provide a fluid flow path from an exterior of the sleeve assembly to the at least one check valve.

In alternate embodiments, an uphole bearing can be located between the sleeve assembly and the uphole body, and a downhole bearing can be located between the sleeve assembly and the downhole body. The uphole bearing can engage a terminal uphole end of the sleeve assembly and can engage a downhole facing shoulder of the uphole body defined at the transition of the first outer diameter and the reduced outer diameter of the uphole body. The downhole bearing can engage a terminal downhole end of the sleeve assembly and can engage a terminal uphole end of the downhole body.

In other alternate embodiments, the system can further include an uphole seal sealing between an inner diameter surface of the sleeve assembly and an outer diameter surface of the reduced outer diameter of the uphole body. The uphole seal can be located axially uphole of the side-entry port. A downhole seal can seal between the inner diameter surface of the sleeve assembly and the outer diameter surface of the reduced outer diameter of the uphole body. The downhole seal can be located axially downhole of the side-entry port.

In yet other alternate embodiments, the sleeve assembly can include an outer sleeve member and an inner sleeve member. The outer sleeve member can have an outer port and the inner sleeve member can have an inner port, and the side-entry port can include the outer port and the inner port. The outer sleeve member can be configured to be rotatable relative to the inner sleeve member between a port open position and a port closed position. In the port open position the outer port can be in fluid communication with the inner port. In the port closed position the outer port can be free of fluid communication with the inner port.

In still other alternate embodiments, the side-entry port can be a normal closed port in which fluid is prevented from passing in either direction through the side-entry port. The side-entry port can be operable to be moved to an open position to provide the fluid flow path from the exterior of the sleeve assembly to the at least one check valve. The side-entry port can have a port actuator operable to move the side-entry port to the open position. The port actuator can be selected from a group consisting of a mechanical actuator, a timer, a hydraulic actuator, a pneumatic actuator, an electrical actuator, a piezoelectric actuator, a photonic actuator, a thermal actuator, a magnetic actuator, or a radio frequency identification actuator. Each of the at least one check valves can be a normal closed valve in which fluid is prevented from passing in either direction through the check valve, and where each of the at least one check valves is operable to be moved to an open position to provide the fluid flow path through the check valve. A ring shaped chamber can circumscribe the uphole body and provide a fluid flow path from the side-entry port to the at least one check valve.

In other alternate embodiments, a clamp can be operable to be releasably engaged with the side-entry port. The clamp can include a nozzle segment being an arc shaped member with an inner diameter profile shaped to engage the side-entry port. A nozzle attachment can extend radially outward from an outer diameter and be sized to engage a side-entry hose. A band segment can be hinged to a band end of the nozzle segment and can have a pin at a second end of the nozzle segment. A cam assembly can have an attachment member extending from a hook end of the nozzle segment. The attachment member can have a hook sized to engage the pin of the band segment. The attachment member can further have a handle operable to rotate relative to the hook end of the nozzle segment to secure the clamp around the sleeve assembly. The side-entry hose can extend from a diversion manifold to the nozzle attachment of the clamp. The side-entry hose can be operable to deliver a drilling mud to the circulation sub for circulation of the drilling mud into a subterranean well. The diversion manifold can have a manifold inlet in fluid communication with a mud pump, a manifold outlet in selective fluid communication with the rig drive, and a side-entry outlet in selective communication with the side-entry hose.

In an alternate embodiment of this disclosure, a method for providing continuous circulation into a drill pipe string with a rotational continuous circulation system includes drilling a subterranean well by rotating a downhole stand of a drill pipe string with a rig drive. A downhole connector end of a circulation sub is connected to the downhole stand of the drill pipe string, and a drilling mud is delivered through the drill pipe string by way of the rig drive. The circulation sub has an internal bore extending along a central axis. An uphole body of the circulation sub is a tubular member with an uphole internal bore. The uphole body has a first outer diameter along an uphole length of the uphole body and has a reduced outer diameter along a downhole length of the uphole body. A downhole body is a tubular member with a downhole internal bore. An uphole portion of the downhole body circumscribes a downhole portion of the uphole body. At least one check valve is located within a sidewall of the uphole body and is operable to selectively allow fluid to flow into the uphole internal bore through the at least one check valve. A sleeve assembly circumscribes the reduced outer diameter of the uphole body. The drill pipe string is set on slips. Drilling mud is diverted to a side-entry port of the sleeve assembly, the side-entry port providing a fluid flow path from an exterior of the sleeve assembly to the at least one check valve. A central valve located within the uphole internal bore is closed to prevent the flow of fluids past the central valve within the uphole internal bore. The drill pipe string is disengaged from the rig drive. The drill pipe string, the uphole body, and the downhole body are rotated about the central axis with a rotary table, free of relative rotation between the uphole body and the downhole body. The uphole body and the downhole body rotate independently from the sleeve assembly. Rotation of the rotary table is stopped and an uphole connector end of the circulation sub is secured to an uphole stand of the drill pipe string. The uphole stand of the drill pipe string is secured to a subsequent circulation sub. The central valve is opened to allow the flow of fluids past the central valve within the uphole internal bore and the drilling mud is delivered through the drill pipe string by way of the rig drive. The drill pipe string is picked up off of the slips. Drilling of the subterranean well is resumed by rotating the uphole stand of the drill pipe string with the rig drive.

In alternate embodiments, the side-entry port can be a normal closed port in which fluid is prevented from passing in either direction through the side-entry port, and the method can include moving the side-entry port to an open position to provide the fluid flow path from the exterior of the sleeve assembly to the at least one check valve. Each of the at least one check valves can be a normal closed valve in which fluid is prevented from passing in either direction through the check valve, and the method can further include moving a check valve an open position to provide the fluid flow path through the check valve. A ring shaped chamber can circumscribe the uphole body and provide a fluid flow path from the side-entry port to the at least one check valve.

In other alternate embodiments, the sleeve assembly can include an outer sleeve member and an inner sleeve member. The outer sleeve member can have an outer port and the inner sleeve member can have an inner port. The side-entry port can include the outer port and the inner port. The method can further include rotating the outer sleeve member relative to the inner sleeve member between a port open position and a port closed position. In the port open position the outer port can be in fluid communication with the inner port, and in the port closed position the outer port can be free of fluid communication with the inner port.

In yet other alternate embodiments, the step of diverting drilling mud to a side-entry port of the sleeve assembly can include engaging the side-entry port with a clamp. The clamp can include a nozzle segment that is an arc shaped member with an inner diameter profile shaped to engage the side-entry port, and a nozzle attachment extending radially outward from an outer diameter sized to engage a side-entry hose. A band segment can be hinged to a band end of the nozzle segment and can have a pin at a second end of the nozzle segment. A cam assembly can have an attachment member extending from a hook end of the nozzle segment. The attachment member can have a hook sized to engage the pin of the band segment. A handle can be operable to rotate relative to the hook end of the nozzle segment to secure the clamp around the sleeve assembly. The side-entry hose can extend from a diversion manifold to the nozzle attachment of the clamp. The side-entry hose can deliver the drilling mud to the circulation sub for circulation of the mud into the subterranean well. Before stopping rotation of the rotary table, the uphole stand can be in a position to be secured to an uphole connector end of the circulation sub.

In still other alternate embodiments, the method can further include after completion of the drilling of the subterranean well, setting the drill pipe string on slips and diverting drilling mud to the side-entry port of the sleeve assembly. The central valve can then be closed to prevent the flow of fluids past the central valve within the uphole internal bore. The uphole stand can be removed from the drill pipe string. The drill pipe string, the uphole body, and the downhole body can rotate about the central axis with the rotary table, free of relative rotation between the uphole body and the downhole body. The uphole body and the downhole body can rotate independently from the sleeve assembly. The uphole stand can be racked back. Rotation of the rotary table can be stopped and the downhole stand can be secured to the rig drive. The central valve can be opened and drilling mud can be delivered through the drill pipe string by way of the rig drive. The drill pipe string can be picked up off of the slips. The uphole stand of the drill pipe string can be pulled in an uphole direction out of the subterranean well with the rig drive. Diverting drilling mud to a side-entry port of the sleeve assembly can include engaging the side-entry port with a clamp, where the clamp includes a nozzle segment being an arc shaped member with an inner diameter profile shaped to engage the side-entry port, and a nozzle attachment extending radially outward from an outer diameter sized to engage a side-entry hose. A band segment can be hinged to a band end of the nozzle segment and having a pin at a second end of the nozzle segment. A cam assembly can have an attachment member extending from a hook end of the nozzle segment. The attachment member can have a hook sized to engage the pin of the band segment and can have a handle operable to rotate relative to the hook end of the nozzle segment to secure the clamp around the sleeve assembly.

BRIEF DESCRIPTION OF THE DRAWINGS

So that the manner in which the previously-recited features, aspects and advantages of the embodiments of this disclosure, as well as others that will become apparent, are attained and can be understood in detail, a more particular description of the disclosure briefly summarized previously may be had by reference to the embodiments that are illustrated in the drawings that form a part of this specification. It is to be noted, however, that the appended drawings illustrate only certain embodiments of the disclosure and are, therefore, not to be considered limiting of the disclosure's scope, for the disclosure may admit to other equally effective embodiments.

DETAILED DESCRIPTION

The disclosure refers to particular features, including process or method steps. Those of skill in the art understand that the disclosure is not limited to or by the description of embodiments given in the specification. The subject matter of this disclosure is not restricted except only in the spirit of the specification and appended Claims.

Those of skill in the art also understand that the terminology used for describing particular embodiments does not limit the scope or breadth of the embodiments of the disclosure. In interpreting the specification and appended Claims, all terms should be interpreted in the broadest possible manner consistent with the context of each term. All technical and scientific terms used in the specification and appended Claims have the same meaning as commonly understood by one of ordinary skill in the art to which this disclosure belongs unless defined otherwise.

As used in the Specification and appended Claims, the singular forms "a", "an", and "the" include plural references unless the context clearly indicates otherwise.

As used, the words "comprise," "has," "includes", and all other grammatical variations are each intended to have an open, non-limiting meaning that does not exclude additional elements, components or steps. Embodiments of the present disclosure may suitably "comprise", "consist" or "consist essentially of" the limiting features disclosed and may be practiced in the absence of a limiting feature not disclosed. For example, it can be recognized by those skilled in the art that certain steps can be combined into a single step.

Where a range of values is provided in the Specification or in the appended Claims, it is understood that the interval encompasses each intervening value between the upper limit and the lower limit as well as the upper limit and the lower limit. The disclosure encompasses and bounds smaller ranges of the interval subject to any specific exclusion provided.

Figure 1:
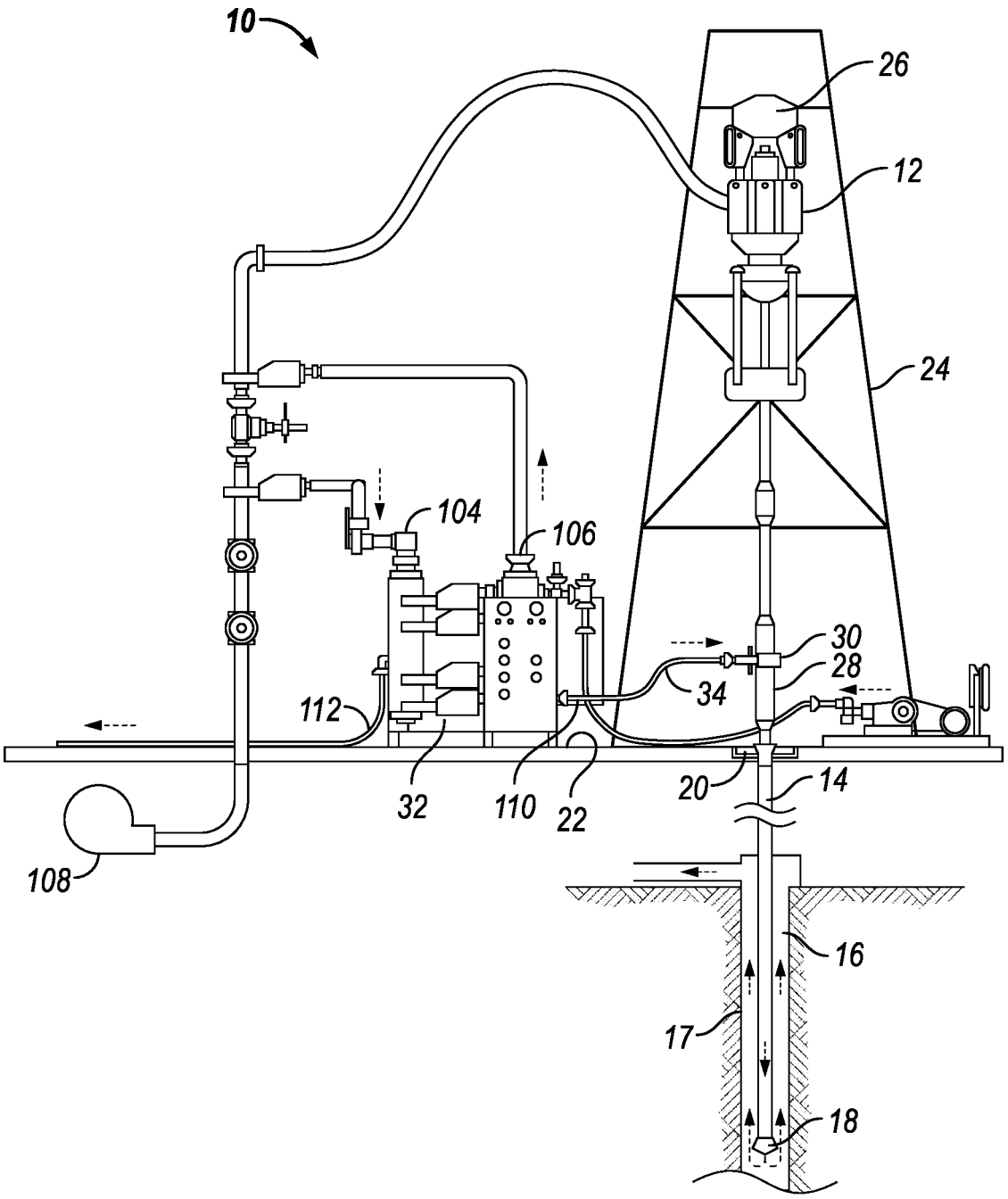
FIG. 1 is a perspective view of a drill rig assembly having a rotational continuous circulation system, in accordance with an embodiment of this disclosure.

Looking at FIG. 1 drilling rig 10 is shown with rig drive 12 being a top drive. In alternate embodiments, rig drive 12 can be a kelly drive system. Drill pipe string 14 includes a series of joints of drill pipes run into wellbore 16 of subterranean well 17. Drill bit 18 can be coupled to a downhole end of drill pipe string 14. Typically, drilling mud is pumped through rig drive 12, through the central bore of drill pipe string 14, and down to drill bit 18, where the drilling mud cools and cleans the drill bit. Continued pumping of drilling mud through rig drive 12 and drill pipe string 14 forces drilling mud at the bottom of wellbore 16 back up wellbore 16 along the annular space defined by the outer diameter surface of drill pipe string 14 and the inner diameter surface of wellbore 16, thereby removing drilled material from wellbore 16. The returned mud is separated from the flushed drilling material and recirculated into wellbore 16.

As shown in FIG. 1, drill pipe string 14 passes through a rotary table 20 in a rig floor 22. Rig floor 22 comprises an upper platform of drilling rig 10 providing a working space for workers as they perform various functions in the drilling process. Rotary table 20 includes a rotationally driven element within rig floor 22 that, when engaged with drill pipe string 14 by a plurality of pipe slips 24 (FIG. 9), may selectively and variably rotate drill pipe string 14 within wellbore 16. Alternately, rotary table 20 and pipe slips 24 can hold drill pipe string 14 stationary within wellbore 16.

Rig drive 12 moveably couples to drilling rig 10 through pulley assembly 26 such that rig drive 12 may move vertically over rotary table 20, and may be used to provide torque both in a clockwise and a counterclockwise direction in order to couple to a subsequent piping element and rotate it. In the illustrated embodiment, rig drive 12 provides the primary means for moving and rotating drill pipe string 14 and providing fluid, such as drilling mud, to drill pipe string 14. A person skilled in the art will understand that alternative means of raising and lowering rig drive 12, such as hydraulically powered lifts, are contemplated and included by the present embodiments.

In some previous systems, to connect and disconnect a new stand of drill pipes, circulation of fluids through drill pipe string 14 and rotation of drill pipe string 14 are stopped. Repeatedly stopping mud circulation causes fluctuations in the bottom hole pressure, as explained herein. In embodiment of this disclosure, a rotational continuous circulation system can be used to maintain circulation of drilling mud and other fluids through drill pipe string 14 when adding or removing stands of drill pipes to drill pipe string 14. The rotational continuous circulation system includes circulation sub 28, clamp 30, and diversion manifold 32. Circulation sub 28 is made up as part of a stand of drill pipes and clamp 30 is secured to circulation sub 28. Clamp 30 is secured to side-entry hose 34 for delivering drilling mud from diversion manifold 32 to drill pipe string 14.

Figure 2:
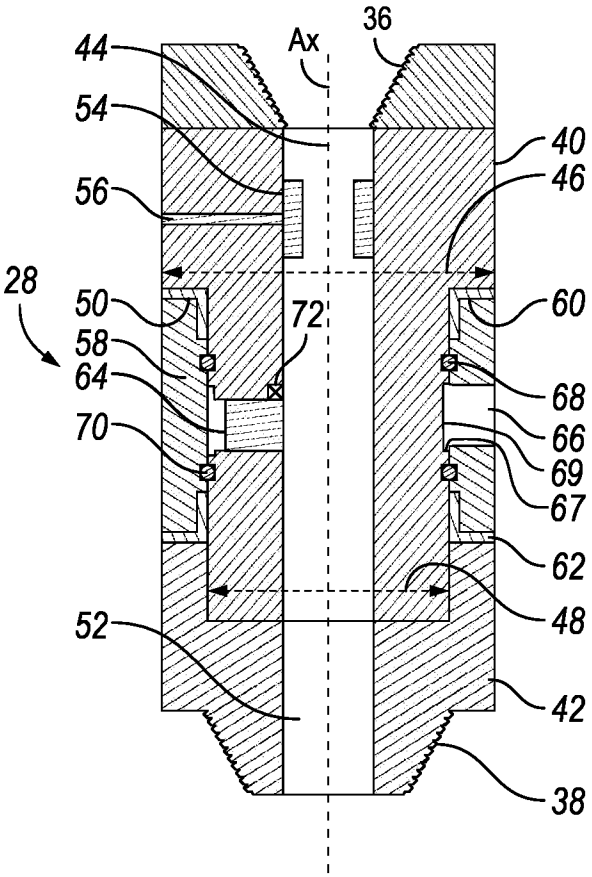
FIG. 2 is a schematic section view of a circulation sub, in accordance with an embodiment of this disclosure.

Looking at FIG. 2, circulation sub 28 is an elongated generally tubular member with an internal bore. The internal bore extends along a central axis Ax of circulation sub 28. Circulation sub 28 is connected in-line as part of drill pipe string 14 (FIG. 1) with uphole connector end 36 and downhole connector end 38. In the example embodiment of FIG. 2, uphole connector end 36 has threads on an inner diameter surface and downhole connector end 38 has threads on an outer diameter surface. The threads of uphole connector end 36 and downhole connector end 38 can be threaded to adjacent joints of drill pipe in drill pipe string 14.

Circulation sub 28 includes uphole body 40 and downhole body 42. Uphole body 40 is a tubular member with uphole internal bore 44. Uphole body 40 has first outer diameter 46 along an uphole length of uphole body 40, and reduced outer diameter 48 along a downhole length of uphole body 40. Downhole facing shoulder 50 of uphole body 40 is defined at the transition of first outer diameter 46 and reduced outer diameter 48 of uphole body 40.

Downhole body 42 is a tubular member with downhole internal bore 52. An uphole portion of downhole body 42 circumscribes a downhole portion of uphole body 40. More specifically, the terminal uphole end portion of downhole body 42 circumscribes a terminal downhole end portion of a length of reduced outer diameter 48. When downhole body 42 is secured to uphole body 40, uphole internal bore 44 and downhole internal bore 52 are axially aligned along central axis Ax.

During operations, when circulation sub 28 is connected in-line as part of drill pipe string 14 and drill pipe string 14 is rotated, uphole body 40 and downhole body 42 are configured to rotate about central axis free of relative rotation between uphole body 40 and downhole body 42. Downhole body 42 is secured to uphole body 40 in such a way that during operation, there is no relative rotation between downhole body 42 and uphole body 40. As an example, downhole body 42 can be threaded to uphole body 40. In alternate embodiments, downhole body 42 can be secured to uphole body 40 by other known connection means.

Central valve 54 is located within uphole internal bore 44. Central valve 54 can open and close uphole internal bore 44. When central valve 54 is in an open position (FIGS. 2 and 4), fluids can flow past central valve 54 within uphole internal bore 44 and the internal bore is considered open. When central valve 54 is in a closed position (FIG. 3), fluids are prevented from flowing past central valve 54 within uphole internal bore 44 and the internal bore is considered closed. Central valve 54 can be operated to move between the open and closed positions from the outside of uphole body 40 by way of control line 56.

Sleeve assembly 58 circumscribes reduced outer diameter 48 of uphole body 40. Sleeve assembly 58 has a ring shaped cross section. Uphole body 40 and downhole body 42 are configured to rotate about central axis Ax independently from sleeve assembly 58. During operations, when circulation sub 28 is connected in-line as part of drill pipe string 14 and drill pipe string 14 is rotated, uphole body 40 and downhole body 42 are configured to rotate about central axis and sleeve assembly 58 can remain stationary relative to side-entry hose 34 and diversion manifold 32.

Uphole bearing 60 is located between sleeve assembly 58 and uphole body 40. Uphole bearing 60 is a ring shaped bearing that circumscribes reduced outer diameter 48 of uphole body 40. Uphole bearing 60 engages downhole facing shoulder 50 of uphole body 40. Uphole bearing 60 further engages the terminal uphole end of sleeve assembly 58.

Downhole bearing 62 is located between sleeve assembly 58 and downhole body 42. Downhole bearing 62 is a ring shaped bearing that circumscribes reduced outer diameter 48 of uphole body 40. Downhole bearing 62 engages a terminal downhole end of sleeve assembly 58. Downhole bearing 62 further engages a terminal uphole end of downhole body 42. Uphole bearing 60 and downhole bearing 62 allow uphole body 40 and downhole body 42 to freely rotate relative to sleeve assembly 58.

Figure 3:
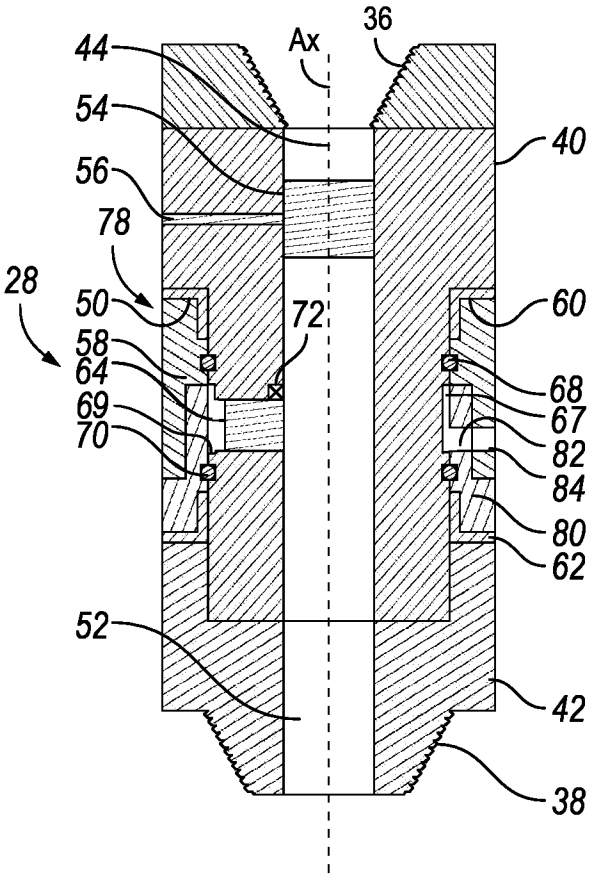
FIG. 3 is a schematic section view of an alternate circulation sub, in accordance with an embodiment of this disclosure, shown with the side-entry port in an open position.
Figure 4:
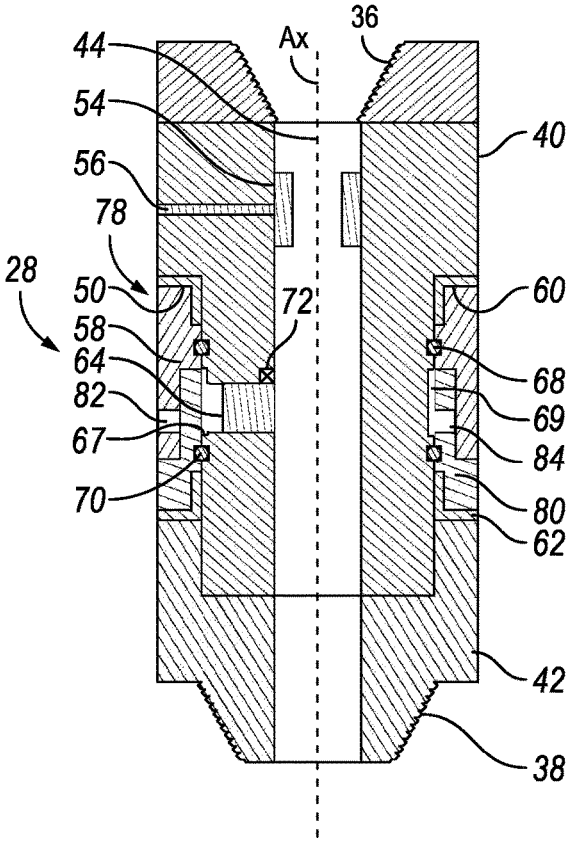
FIG. 4 is a schematic section view of the circulation sub of FIG. 3, in accordance with an embodiment of this disclosure, shown with the side-entry port in a closed position.

At least one check valve 64, shown schematically in FIGS. 2-4, is located within a sidewall of uphole body 40. Check valve 64 is a one way valve that provides a fluid flow path for fluids flowing in a direction from exterior of uphole body 40, through check valve 64 and into uphole internal bore 44. Check valve 64 prevents the flow of fluids in a direction from within uphole internal bore 44 to exterior of uphole body 40. Although only one check valve 64 is shown, multiple check valves 64 can be distributed within the sidewall of uphole body 40 to minimize the flow rate through each of the check valves 64, for erosion resistance. Each check valve 64 can be a normal closed valve in which fluid is prevented from passing in either direction through check valve 64 in the normal closed position. Each of the at least one check valves 64 can be moved to an open position to provide a fluid flow path through the check valve 64.

Side-entry port 66 extends through sleeve assembly 58, providing a fluid flow path from an exterior of sleeve assembly 58 to check valve 64. In the embodiments of FIGS. 2-4, uphole body 40 has a circumferential groove 67 located on an outer diameter surface of uphole body 40. Circumferential groove 67 provides a ring shaped chamber 69 between the outer surface of uphole body 40 and an inner diameter surface of sleeve assembly 58. Ring shaped chamber 69 circumscribes uphole body 40 and provides a fluid flow path from side-entry port 66 to at least one check valve 64. Fluid that enters through side-entry port 66 can travel through ring shaped chamber 69 to reach a check valve 64. In alternate embodiments, a groove can instead be formed in sleeve assembly 58, or can be formed in both of uphole body 40 and sleeve assembly 58 to define ring shaped chamber 69.

Uphole seal 68 seals between an inner diameter surface of sleeve assembly 58 and an outer diameter surface of reduced outer diameter 48 of uphole body 40. Uphole seal 68 circumscribes reduced outer diameter 48 of uphole body 40. Uphole seal 68 is located axially uphole of side-entry port 66. Downhole seal 70 seals between an inner diameter surface of sleeve assembly 58 and an outer diameter surface of reduced outer diameter 48 of uphole body 40. Downhole seal 70 circumscribes reduced outer diameter 48 of uphole body 40. Downhole seal 70 is located axially downhole of side-entry port 66.

During drilling and development operations relating to subterranean well 17, pressure can build up within wellbore 16, such as during shut-in in a well control situation. If the pressure of the fluid within wellbore 16 is sufficient, such fluid might leak from the annular space of wellbore 16 defined by the outer diameter surface of drill pipe string 14 and the inner diameter surface of wellbore 16, and through check valve 64 into uphole internal bore 44. To avoid such leaks into the internal bore of circulation sub 28, access to the internal bore of circulation sub 28 will be locked when circulation sub 28 is downhole. A normal closed flow path between the outside of circulation sub 28 and the internal bore of circulation sub 28 can provide such functionality. Side-entry port 66 is a normal closed port that prevents leaks between fluids within wellbore 16 and the internal bore of circulation sub 28, even when pressures within the annular space of wellbore 16 defined by the outer diameter surface of drill pipe string 14 and the inner diameter surface of wellbore 16 are larger than pressures within uphole internal bore 44.

When side-entry port 66 is in the normal closed position, fluid is prevented from passing in either direction through side-entry port 66. When side-entry port is moved from the normal closed position to the open position, fluid can pass through side-entry port in a direction from exterior of uphole body 40, through check valve 64 and into uphole internal bore 44. Check valve 64 can be a normal closed valve and can be the mechanism through which fluid is prevented from passing through side-entry port 66 in either direction when side-entry port 66 is considered to be in a normal closed position. Alternately, a separate mechanism can be used for side-entry port 66 to be a normal closed port.

Port actuator 72, shown schematically in FIGS. 2-4, can move side-entry port 66 or a check valve 64 from the normal closed position to the open position. Port actuator 72 can, for example, move side-entry port 66 to an open position when side-entry port is in fluid communication with diversion manifold 32 (FIG. 1) so that drilling mud can be delivered through side-entry port 66 and into drill pipe string 14.

In embodiments of this disclosure, port actuator 72 is a mechanical actuator. As an example, a key-on-sub or a key-on-clamp can be used to move check valve 64 or a separate valve member of side-entry port 66 to an open position when circulation sub 28 is physically accessible by an operator at the surface. When the key sets in a corresponding seat, side-entry port 66 is moved to an open position. When the key is removed, side-entry port 66 returns to the normal closed position. The mechanical actuator can alternately be a nipple, mechanical lever, or a control line. In each case, when the mechanical actuator is released, side-entry port 66 will return to and remain at the normal closed position.

In other alternate embodiments, port actuator 72 can be a hydraulic or pneumatic actuator. Alternately, port actuator 72 can be a pressure-wave-actuated valve. In such an embodiment, different hydraulic wave sequences can be used for moving side-entry port 66 or a check valve 64 to the open position. These waves can be sent to the pressure wave actuated valve through drill pipe string 14 or through dedicated control-lines within the body of circulation sub 28.

Figure 5A:
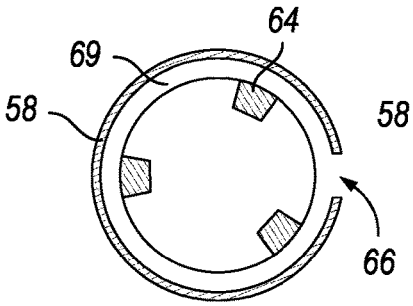
FIGS. 5A-5C are schematic section views of the operation of a hydro-mechanical plug that seals the side-entry port of a circulation sub, in accordance with an embodiment of this disclosure.
Figure 5B:
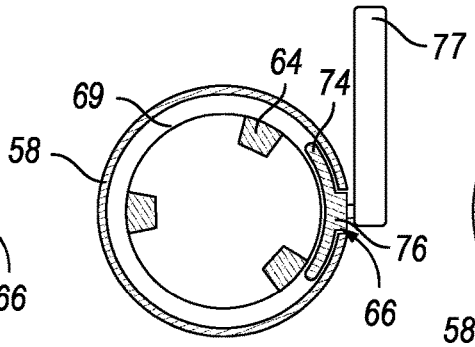
Figure 5C:
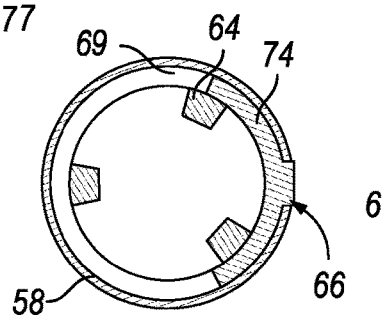

Looking at FIGS. 5A-5C, in still other alternate embodiments, port actuator 72 can include hydro-mechanical plug 74 that seals side-entry port 66 when side-entry port 66 is downhole. In the example embodiments of FIGS. 5A-5C, three check valves 64 are shown.

Hydro-mechanical plug 74 can include a tube made of natural rubber with a hard plug 76 at one end. The profile of hard plug 76 matches the profile of side-entry port 66 so that hydro-mechanical plug 74 can be set in and seal side-entry port 66. Looking at FIG. 5B, after circulation sub is run downhole, hydro-mechanical plug 74 can be manually or automatically inserted inside the fluid side pathway with injection tool 77 until the hard plug 76 of hydro-mechanical plug 74 sets in. Hydro-mechanical plug 74 extends along ring shaped chamber 69. Looking at FIG. 5C, hydro-mechanical plug 74 can then be inflated with a gas or a liquid so that positive pressure is prevented from developing, differential pressure is equalized, and hydro-mechanical plug 74 is held in place. When inflated, hydro-mechanical plug 74 blocks the fluid flow path between side-entry port 66 and all of the check valves 64.

In alternate embodiments, port actuator 72 can include a timer. The timer can be used to move side-entry port 66, to move one or more of the at least one check valves 64, or to move a combination of side-entry port 66 and check valves 64. The time can move the side-entry port or the one or more check valves 64 to the open position and can maintain such side-entry port 66 or one or more check valves 64 in the open position for a specific period of time while circulation sub 28 is at the surface. At the end of the specific period of time, side-entry port 66 and the side check valves 64 will return to and remain at the normal closed position.

In other alternate embodiments of this disclosure, port actuator 72 is an electrical actuator. As an example, an electrical signal can be used to move check valve 64 or a separate valve member of side-entry port 66 to an open position when circulation sub 28. By applying electricity to an electric sensor or actuator, side-entry port 66 moves to the open position. Electricity can be supplied wireless or through a wire. When the delivery of electricity to port actuator 72 stops, side-entry port 66 will return to and remain at the normal closed position.

In yet other alternate embodiments of this disclosure, port actuator 72 is a piezoelectrically actuated actuator. As an example, piezoelectric materials can be used in check valve 64 or a separate valve member of side-entry port 66. Electrical charges can be applied to the piezoelectric materials to move such check valve 64 or separate valve member of side-entry port 66 to an open position when circulation sub 28 is at the surface. The electrical charge can contract the piezoelectric materials to move side-entry port 66 to an open position. A mechanical amplifier can be used to amplify the magnitude of the contraction of the piezoelectric material. When the delivery of electrical charges to port actuator 72 stops, side-entry port 66 will return to and remain at the normal closed position.

In still other alternate embodiments, port actuator 72 is a photonically actuated actuator. As an example, photonic sensors can be used in check valve 64 or a separate valve member of side-entry port 66. Continuous light can be delivered to the photonic sensors to move such check valve 64 or separate valve member of side-entry port 66 to an open position when circulation sub 28 is at the surface. When the delivery of light to port actuator 72 stops, side-entry port 66 will return to and remain at the normal closed position.

In yet other alternate embodiments of this disclosure, port actuator 72 is a thermally actuated actuator. Materials can be used in check valve 64 or a separate valve member of side-entry port 66 that expand and contract with changes in temperature. As an example, fluids that expands and contracts inside the check valve 64 or the separate valve member can drive such valve to an open position. Heat can be applied to port actuator 72 to move such check valve 64 or separate valve member of side-entry port 66 to an open position when circulation sub 28 is at the surface. When port actuator 72 cools, side-entry port 66 will return to and remain at the normal closed position.

In yet other alternate embodiments of this disclosure, port actuator 72 is a magnetically actuated actuator. As an example, a magnetically released lock can be used in check valve 64 or a separate valve member of side-entry port 66. Clamp 30 can be the port actuator 72 and have a magnetic coil that will move such check valve 64 or separate valve member of side-entry port 66 to an open position when circulation sub 28 is at the surface. When clamp 30 is removed, side-entry port 66 will return to and remain at the normal closed position.

In still further alternate embodiments of this disclosure, port actuator 72 is a radio frequency identification actuated actuator. As an example, a radio frequency identification tag can be used in check valve 64 or a separate valve member of side-entry port 66. A radio transponder, both receiver and transmitter, can be located at the surface. The electromagnetic interrogation pulse in the radio frequency identification tag transponder will trigger the radio frequency identification tag. The radio frequency identification will transmit a signal back to the radio transponder that would allow side-entry port 66 to move to an open position. When no proximity signal is received by radio frequency identification tag transponder from the radio frequency identification tag, side-entry port 66 will return to and remain at the normal closed position.

Looking at FIGS. 3-4, side-entry port 66 can be moved between a closed position and an open position with sleeve assembly 58 that includes outer sleeve member 78 and inner sleeve member 80. In the example embodiments of FIGS. 3-4, outer sleeve member 78 is positioned uphole of inner sleeve member 80. A downhole portion of outer sleeve member 78 circumscribes an uphole portion of inner sleeve member 80.

The downhole portion of outer sleeve member 78 includes outer port 82. Outer port 82 extends through the sidewall of outer sleeve member 78. Uphole portion of inner sleeve member 80 includes inner port 84. Side-entry port 66 includes outer port 82 and inner port 84.

In such an embodiment, the relative rotational position of outer sleeve member 78 and inner sleeve member 80 itself acts as a port actuator. Outer sleeve member 78 is configured to be rotatable relative to inner sleeve member 80 between a port open position and a port closed position. In the port open position (FIG. 3) outer port 82 is in fluid communication with inner port 84, and in the port closed position (FIG. 4) outer port 82 is free of fluid communication with inner port 84.

Looking at FIG. 3, when circulation sub 28 is at the surface, outer port 82 can be aligned with and in fluid communication with inner port 84 so that side-entry port 66 is in an open position. Outer port 82 and inner port 84 can be manually or automatically aligned when circulation sub 28 is at the surface. Looking at FIG. 4, when side-entry port 66 is in a closed position, outer port 82 and inner port 84 are no longer aligned and fluid is blocked from passing through side-entry port 66.

Looking at FIG. 1, clamp 30 of rotational continuous circulation system is secured around circulation sub 28 so that clamp 30 releasably engages side-entry port 66 (FIG. 2). Looking at FIG. 6, clamp 30 includes nozzle segment 86. Nozzle segment 86 is an arc shaped member with an inner diameter profile shaped to engage side-entry port 66. Nozzle attachment 88 extends radially outward from an outer diameter of nozzle segment 86. Nozzle attachment 88 is sized to engage side-entry hose 34 (FIG. 1).

Band segment 90 is hinged with a hinge assembly to a band end of nozzle segment 86. Band segment 90 further includes pin 92 located at a second end of band segment that is opposite the hinge assembly. Pin 92 is positioned to be parallel to a longitudinal axis 94 that extends through clamp 30.

Figure 6:
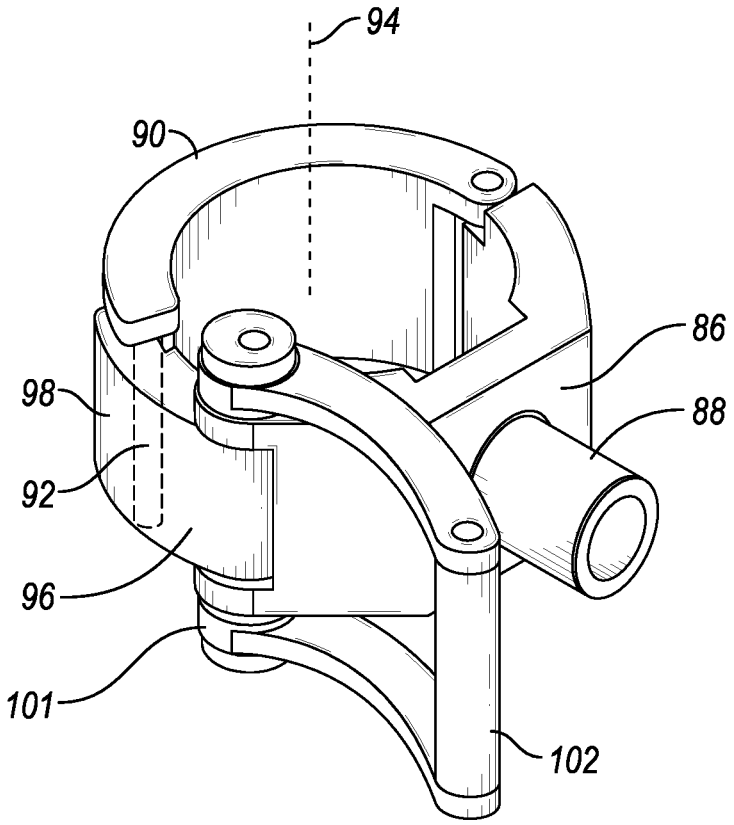
FIG. 6 is a perspective view of a clamp of a rotational continuous circulation system, in accordance with an embodiment of this disclosure.
Figure 7:
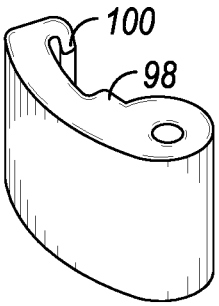
FIG. 7 is a section view of an attachment member of the clamp of FIG. 6, in accordance with an embodiment of this disclosure.

Cam assembly 96 further includes attachment member 98. Attachment member 98 is rotationally secured to a hook end of nozzle segment 86 with cam joint 101. The hook end of nozzle segment 86 is opposite band end of nozzle segment 86. Looking at FIG. 7, attachment member 98 has hook 100 that is sized to engage pin 92 of band segment 90 (FIG. 6). Looking at FIG. 6, attachment member 98 also includes handle 102. Handle 102 can rotate about cam joint 101 of the hook end and rotate relative to hook end of nozzle segment 86. Rotating handle 102 about cam joint 101 can secure clamp 30 around sleeve assembly 58.

During drilling operations when drilling mud is to be provided through circulation sub 28, an operator can bring clamp 30 proximate to circulation sub 28. Band segment 90 will be swung out and open so that longitudinal axis 94 of clamp 30 can be co-axially aligned with central axis Ax of circulation sub 28. Band segment 90 can then be swung back so that hook 100 of attachment member 98 can be hooked around pin 92, as shown in FIG. 6. Handle 102 can be rotated about cam joint 101 can secure clamp 30 around sleeve assembly 58.

Looking at FIG. 1, diversion manifold 32 includes manifold inlet 104 and manifold outlet 106. Manifold inlet 104 is in fluid communication with mud pump 108. Mud pump 108 delivers drilling mud, and any additives or other fluids to be delivered downhole, to diversion manifold by way of manifold inlet 104.

Manifold outlet 106 is in selective fluid communication with rig drive 12. During drilling operations, mud pump 108 can pump drilling mud to rig drive 12 by way of manifold outlet 106, for delivery to wellbore 16. The drilling mud can travel in a downhole direction through the central bore of drill pipe string 14 to drill bit 18. Drilling mud at the bottom of wellbore 16 is forced back up wellbore 16 along the annular space defined by the outer diameter surface of drill pipe string 14 and the inner diameter surface of wellbore 16, thereby removing drilled material from wellbore 16.

When a new stand is added to or removed from the pipe string, drilling mud can instead be delivered through side-entry hose 34 by way of side-entry outlet 110 of diversion manifold 32. Side-entry outlet 110 is in selective fluid communication with side-entry hose 34. Side-entry hose 34 extends from diversion manifold 32 to nozzle attachment 88 of clamp 30. Side-entry hose 34 is operable to deliver a drilling mud to circulation sub 28 for circulation of the drilling mud into subterranean well 17.

When drilling mud is delivered out of side-entry outlet 110, the drilling mud can travel through circulation sub 28 and can travel in a downhole direction through the central bore of drill pipe string 14 to drill bit 18. Drilling mud at the bottom of wellbore 16 is forced back up wellbore 16 along the annular space defined by the outer diameter surface of drill pipe string 14 and the inner diameter surface of wellbore 16, thereby removing drilled material from wellbore 16.

Mud pump 108 can operate continuously when a new stand is added to or removed from drill pipe string 14. Drilling mud can be diverted from manifold outlet 106 to side-entry outlet 110 when a new stand is added to or removed from drill pipe string 14. When drilling mud is being delivered to side-entry outlet 110, central valve 54 is closed, any remaining drilling mud within the fluid flow path between manifold outlet 106 and rig drive 12 can be bled off through bleed off line 112. When drilling mud is being delivered through manifold outlet 106, any remaining drilling mud within side-entry hose 34 can be bled off through bleed off line 112.

In an example of operation, FIGS. 8-16 show drilling rig 10 in various operational steps of the use of the rotational continuous circulation system. In the example embodiments of FIGS. 8-16, axial movement of drill pipe string 14 is accomplished by a combination of pulley assembly 26 (FIG. 1) and the set down weight of drill pipe string 14.

Figure 8:
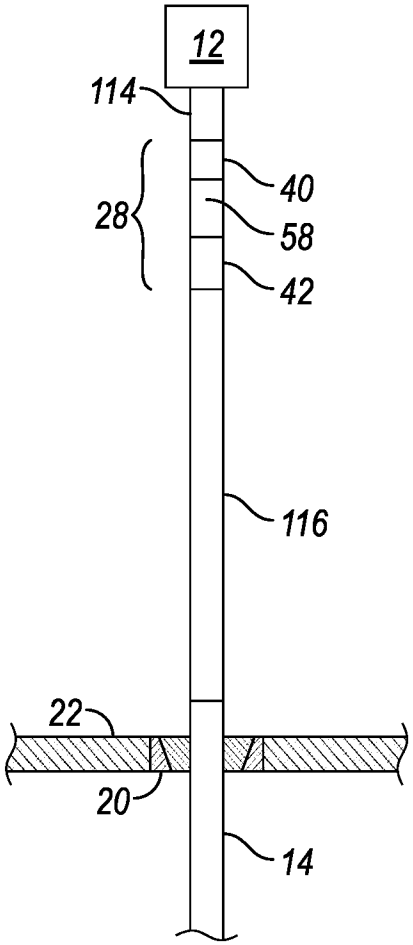

As shown in FIG. 8, circulation sub 28 couples to quill 114. Quill 114 couples to uphole body 40 of circulation sub 28. Downhole body 42 of circulation sub 28 couples to an upper end of downhole stand 116 of drill pipe string 14. Drill pipe string 14 passes through an opening in rig floor 22 between opposite sides of rotary table 20. Drilling mud is pumped through rig drive 12, past central valve 54 (FIG. 2) of circulation sub 28, which is in an open position, and into drill pipe string 14. Check valve 64 is closed, preventing drilling mud from flowing across the sidewall of circulation sub 28. Rig drive 12 can rotate downhole stand 116 of drill pipe string 14 so that subterranean well 17 (FIG. 1) is being drilled.

Figure 9:
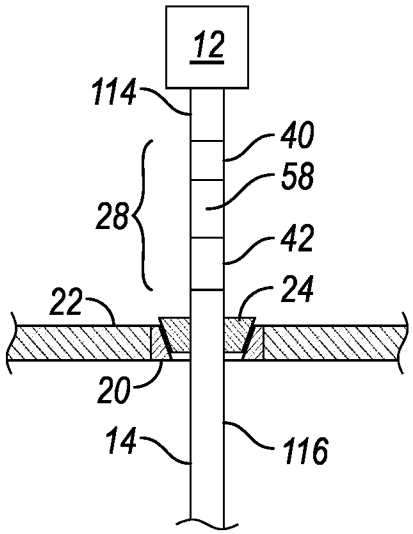

As subterranean well 17 is drilled, rig drive 12 is lowered to the position shown in FIG. 9. This brings the uphole end of downhole stand 116 and circulation sub 28 proximate to a top surface of rotary table 20. Rig drive 12 then stops rotation while a plurality of pipe slips 24 are inserted into a space between drill pipe string 14 and rotary table 20. Rig drive 12 then slightly raises and drill pipe string 14 to set pipe slips 24.

Figure 10:
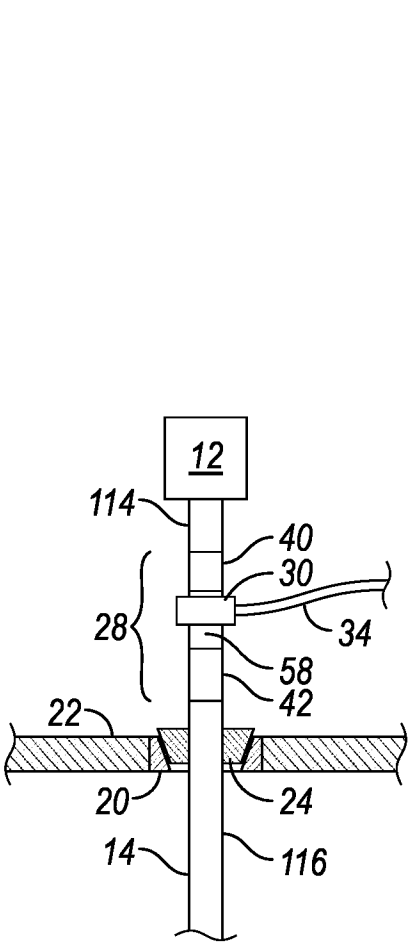
FIGS. 8-16 are sectional illustrations of operational steps of the use of a rotational continuous circulation system, in accordance with an embodiment of this disclosure.

Looking at FIG. 10, clamp 30 can be connected to uphole body 40 of circulation sub 28 at side-entry port 66. Band segment 90 will be swung out and open so that longitudinal axis 94 of clamp 30 can be co-axially aligned with central axis Ax of circulation sub 28. Band segment 90 can then be swung back closed so that hook 100 of attachment member 98 can be hooked around pin 92, as shown in FIG. 6. Handle 102 can be rotated about cam joint 101 can secure clamp 30 around sleeve assembly 58.

Side-entry port 66 can be moved to an open position and drilling mud can be diverted to side-entry port 66 of sleeve assembly 58 by way of side-entry hose 34. Central valve 54 is then closed, preventing the flow of fluids past central valve 54 within uphole internal bore 44 (FIG. 3).

Figure 11:
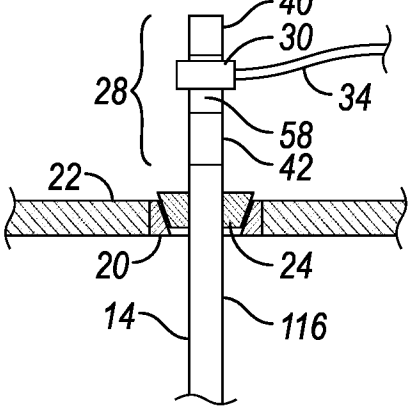

Drilling mud is pumped through side-entry hose 43, past check valve 64, and into the internal bore of circulation sub 28, and then into drill pipe string 14. The flow of drilling mud through rig drive 12 stops, and the flow of drilling mud through side-entry port 66 is started without turning off mud pump 108. Any remaining drilling mud within the fluid flow path between manifold outlet 106 and rig drive 12 can be bled off. Drill pipe string 14 can be disengaged from rig drive 12 by unscrewing uphole body 40 of circulation sub 28 from quill 114, as shown in FIG. 11.

Rotary table 20 can then rotate drill pipe string 14 with drill pipe string 14 supported by pipe slips 24. During such rotation, both uphole body 40 and downhole body 42 rotate with drill pipe string 14, and free of any relative rotational movement between uphole body 40 and downhole body 42. Uphole body 40 and downhole body 42 rotate independently from sleeve assembly 58. Sleeve assembly 58 can remain stationary relative to side-entry hose 34 as drill pipe string 14, uphole body 40, and downhole body 42 rotate together.

Figure 12:
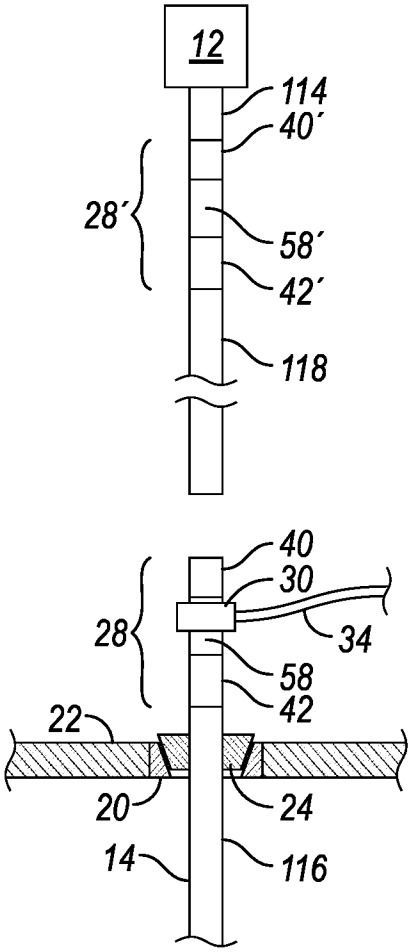

Looking at FIG. 12, uphole stand 118 can be made up of additional joints of drill pipe. Uphole stand 118 can be secured to subsequent circulation sub 28'. Subsequent circulation sub 28' includes each of the features of circulation sub 28 and operates in the same way as circulation sub 28. Quill 114 of rig drive 12 can be secured to uphole body 40' of subsequent circulation sub 28'. Uphole stand 118 can be supported by rig drive 12 and located in a position to be secured to uphole connector end of the subsequent circulation sub 28'. After positioning uphole stand 118, rotation of rotary table 20 can be stopped.

Figure 13:
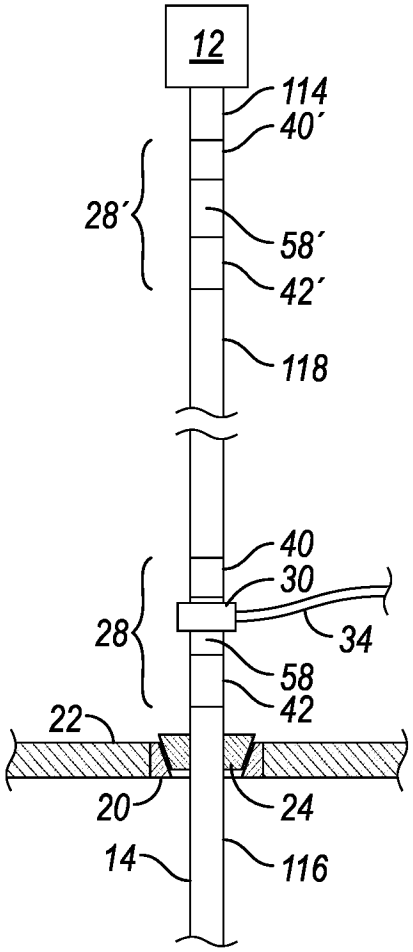

Looking at FIG. 13, drilling rig 10 can manipulate rig drive 12 to secure an uphole connector end of circulation sub 28 to uphole stand 118 of drill pipe string 14. The central valve of subsequent circulation sub 28' will be in an open position and the side-entry port of subsequent circulation sub 28' will be in a closed position. Central valve 54 of circulation sub 28 can then be opened to allow for the flow of fluids past central valve 54 within uphole internal bore 44 of circulation sub 28. Drilling mud can be directed through rig drive 12 to the central bore of drill pipe string 14. Side-entry port 66 of circulation sub 28 can be returned to a closed position. Any remaining drilling mud within side-entry hose 34 can be bled off.

Figure 14:
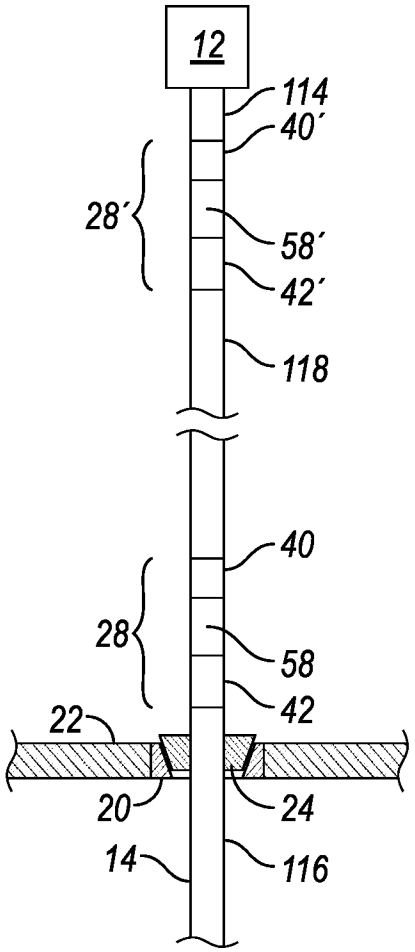

Looking at FIG. 14, clamp 30 can be removed from circulation sub 28. Looking at FIG. 6, In order to remove clamp 30, handle 102 can be rotated about cam joint 101 to unsecure clamp 30 from sleeve assembly 58. Band segment 90 will be swung out so that hook 100 of attachment member 98 can be unhooked from around pin 92. Band segment 90 can then be swung out and open so that clamp 30 can be removed from circulation sub 28.

Rig drive 12 can lift drill pipe string 14, picking drill pipe string off of pipe slips 24. Pipe slips 24 can be removed. Looking at FIG. 15, drill pipe string 14 is disengaged from rotary table 20. Rig drive 12 can start rotating, causing rotation of drill pipe string 14. Circulating mud can continue to be pumped through rig drive 12 and down the central bore of drill pipe string 14. As subterranean well 17 is drilled, rig drive 12 is lowered to the position shown in FIG. 16. This brings the uphole end of uphole stand 118 and subsequent circulation sub 28' proximate to a top surface of rotary table 20. The process repeats as described above.

The total number of circulation subs to be used depends on the depth of open-hole section of subterranean well 17, and the length of each pipe stand. As an example, if each pipe stand is 100 feet in length and the open-hole section of subterranean well 17 is 3,000 to 5,000 feet in length, then thirty to fifty circulation subs would be used.

When pulling drill pipe string 14 out of subterranean well 17, then the steps outlined in reference to FIGS. 8-16 are generally reversed. Looking at FIG. 16, rig drive 12 is rotating drill pipe string 14 within subterranean well 17. Central valve 54 is open with drilling mud being pumped through rig drive 12. Side-entry port 66 is in a closed position.

Figure 15:
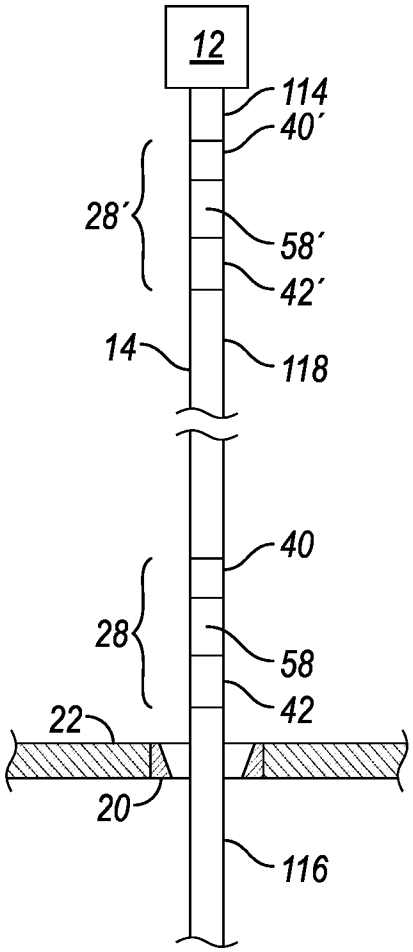
Figure 16:
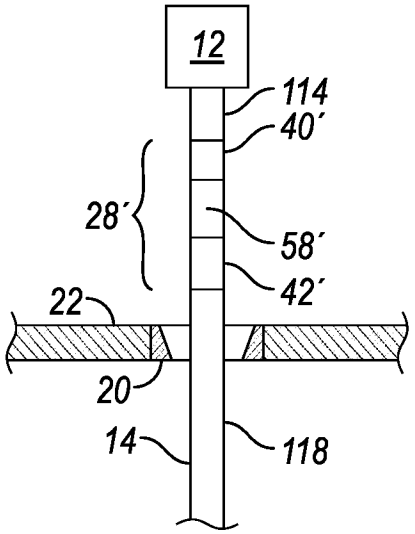

Drilling rig 10 can manipulate rig drive 12 to draw drill pipe string 14 in a direction out of subterranean well 17 until the uphole end of downhole stand 116 and circulation sub 28 proximate to a top surface of rotary table 20, as shown in FIG. 15.

Looking at FIG. 14, rig drive 12 then stops rotation while a plurality of pipe slips 24 are inserted into a space between drill pipe string 14 and rotary table 20. Rig drive 12 then can set drill pipe string 14 on pipe slips 24.

Looking at FIG. 13, clamp 30 is secured to sleeve assembly 58 of circulation sub 28. Side-entry port 66 can be moved to an open position and drilling mud can be diverted to side-entry port 66 of sleeve assembly 58 by way of side-entry hose 34. Central valve 54 is then closed, preventing the flow of fluids past central valve 54 within uphole internal bore 44. Any remaining drilling mud within the fluid flow path between manifold outlet 106 and rig drive 12 can be bled off.

Looking at FIG. 12, uphole stand 118 can be unthreaded from circulation sub 28 and can be supported by rig drive 12. Rotary table 20 can then rotate drill pipe string 14 with drill pipe string 14 supported by pipe slips 24. Uphole stand 118 can be unsecured from rig drive 12 by unthreading uphole body 40' of subsequent circulation sub 28' from Quill 114 and set aside on drilling rig 10, which is known as racking back uphole stand 118. This leaves the uphole end of circulation sub 28 unattached to any other member, as shown in FIG. 11.

Looking at FIG. 10, rotation of rotary table 20 can be stopped and rig drive 12 can engage downhole stand 116 of drill pipe string 14 by coupling quill 114 to uphole body 40 of circulation sub 28. Central valve 54 of circulation sub 28 can then be opened to allow for the flow of fluids past central valve 54 within uphole internal bore 44 of circulation sub 28. Drilling mud can be directed through rig drive 12 to the central bore of drill pipe string 14. Side-entry port 66 of circulation sub 28 can be returned to a closed position. Any remaining drilling mud within side-entry hose 34 can be bled off.

Looking at FIG. 9, clamp 30 can then be removed from circulation sub 28. Rig drive 12 can lift drill pipe string 14, picking drill pipe string off of pipe slips 24. Pipe slips 24 can be removed. Looking at FIG. 8, drill pipe string 14 is disengaged from rotary table 20. Downhole stand 116 will be pulled in an uphole direction out of subterranean well 17 with drilling rig 10. This process of removing circulation sub 28 can be repeated for any remaining circulation subs secured in line as part of drill pipe string 14.

Systems and methods of this disclosure therefore reduce the amount of time that the drill pipe string rotation is stopped compared to currently available systems. For example, rotation of the pipe string pauses only long enough to attach or detach the clamp, operate valves, and thread on or off a drill pipe stand. In addition, systems and methods of this disclosure provide for near continuous circulation of drilling mud through the pipe string.

Embodiments of this disclosure, therefore, are well adapted to carry out the objects and attain the ends and advantages mentioned, as well as others that are inherent. While embodiments of the disclosure has been given for purposes of disclosure, numerous changes exist in the details of procedures for accomplishing the desired results. These and other similar modifications will readily suggest themselves to those skilled in the art, and are intended to be encompassed within the spirit of the present disclosure and the scope of the appended claims.

What is claimed is:

1. A rotational continuous circulation system for connection into a drill pipe string, the system including:

a circulation sub having an internal bore extending along a central axis, the circulation sub having:

an uphole connector end and a downhole connector end for connection in-line with stands of the drill pipe string;

an uphole body that is a tubular member with an uphole internal bore, the uphole body having a first outer diameter along an uphole length of the uphole body and having a reduced outer diameter along a downhole length of the uphole body;

a central valve located within the uphole internal bore and operable to selectively open and close the uphole internal bore;

at least one check valve is located within a sidewall of the uphole body and operable to selectively allow fluid to flow into the uphole internal bore through the at least one check valve;

a downhole body that is a tubular member with a downhole internal bore, an uphole portion of the downhole body circumscribing a downhole portion of the uphole body; and a sleeve assembly circumscribing the reduced outer diameter of the uphole body; where the uphole body and the downhole body are configured to rotate about the central axis free of relative rotation between the uphole body and the downhole body;

the uphole body and the downhole body are configured to rotate about the central axis independently from the sleeve assembly; and a side-entry port of the sleeve assembly is operable to provide a fluid flow path from an exterior of the sleeve assembly to the at least one check valve.

2. The system of claim 1, further including an uphole bearing located between the sleeve assembly and the uphole body, and a downhole bearing located between the sleeve assembly and the downhole body.

3. The system of claim 2, where the uphole bearing engages a terminal uphole end of the sleeve assembly and engages a downhole facing shoulder of the uphole body defined at a transition of the first outer diameter and the reduced outer diameter of the uphole body.

4. The system of claim 2, where the downhole bearing engages a terminal downhole end of the sleeve assembly and engages a terminal uphole end of the downhole body.

5. The system of claim 1, further including:

an uphole seal sealing between an inner diameter surface of the sleeve assembly and an outer diameter surface of the reduced outer diameter of the uphole body, the uphole seal being located axially uphole of the side-entry port; and a downhole seal sealing between the inner diameter surface of the sleeve assembly and the outer diameter surface of the reduced outer diameter of the uphole body, the downhole seal being located axially downhole of the side-entry port.

6. The system of claim 1, where the sleeve assembly includes an outer sleeve member and an inner sleeve member, the outer sleeve member having an outer port and the inner sleeve member having an inner port, and where the side-entry port includes the outer port and the inner port.

7. The system of claim 6, where the outer sleeve member is configured to be rotatable relative to the inner sleeve member between a port open position and a port closed position, where in the port open position the outer port is in fluid communication with the inner port and in the port closed position the outer port is free of fluid communication with the inner port.

8. The system of claim 1, where the side-entry port is a normal closed port in which fluid is prevented from passing in either direction through the side-entry port, and where the side-entry port is operable to be moved to an open position to provide the fluid flow path from the exterior of the sleeve assembly to the at least one check valve.

9. The system of claim 8, where the side-entry port has a port actuator operable to move the side-entry port to the open position, where the port actuator is selected from a group consisting of a mechanical actuator, a timer, a hydraulic actuator, a pneumatic actuator, an electrical actuator, a piezoelectric actuator, a photonic actuator, a thermal actuator, a magnetic actuator, or a radio frequency identification actuator.

10. The system of claim 1, where each of the at least one check valves is a normal closed valve in which fluid is prevented from passing in either direction through the check valve, and where each of the at least one check valves is operable to be moved to an open position to provide the fluid flow path through the check valve.

11. The system of claim 1, further including a ring shaped chamber circumscribing the uphole body and providing a fluid flow path from the side-entry port to the at least one check valve.

12. The system of claim 1, further having a clamp operable to be releasably engaged with the side-entry port, where the clamp includes:

a nozzle segment being an arc shaped member with an inner diameter profile shaped to engage the side-entry port, and a nozzle attachment extending radially outward from an outer diameter sized to engage a side-entry hose;

a band segment hinged to a band end of the nozzle segment and having a pin at a second end of the nozzle segment; and a cam assembly having an attachment member extending from a hook end of the nozzle segment, the attachment member having a hook sized to engage the pin of the band segment, and having a handle operable to rotate relative to the hook end of the nozzle segment to secure the clamp around the sleeve assembly.

13. The system of claim 12, where the side-entry hose extends from a diversion manifold to the nozzle attachment of the clamp, the side-entry hose operable to deliver a drilling mud to the circulation sub for circulation of the drilling mud into a subterranean well.

14. The system of claim 13, where the diversion manifold has a manifold inlet in fluid communication with a mud pump, a manifold outlet in selective fluid communication with a rig drive, and a side-entry outlet in selective communication with the side-entry hose.

15. A method for providing continuous circulation into a drill pipe string with a rotational continuous circulation system, the method including:

drilling a subterranean well by rotating a downhole stand of the drill pipe string with a rig drive, where a downhole connector end of a circulation sub is connected to the downhole stand of the drill pipe string, and delivering a drilling mud through the drill pipe string by way of the rig drive, where the circulation sub has:

an internal bore extending along a central axis;

an uphole body that is a tubular member with an uphole internal bore, the uphole body having a first outer diameter along an uphole length of the uphole body and having a reduced outer diameter along a downhole length of the uphole body;

a downhole body that is a tubular member with a downhole internal bore, an uphole portion of the downhole body circumscribing a downhole portion of the uphole body;

at least one check valve located within a sidewall of the uphole body and operable to selectively allow fluid to flow into the uphole internal bore through the at least one check valve; and a sleeve assembly circumscribing the reduced outer diameter of the uphole body;

setting the drill pipe string on slips;

diverting the drilling mud to a side-entry port of the sleeve assembly, the side-entry port providing a fluid flow path from an exterior of the sleeve assembly to the at least one check valve;

closing a central valve located within the uphole internal bore to prevent a flow of fluids past the central valve within the uphole internal bore;

disengaging the drill pipe string from the rig drive;

rotating the drill pipe string, the uphole body, and the downhole body about the central axis with a rotary table, free of relative rotation between the uphole body and the downhole body, where the uphole body and the downhole body rotate independently from the sleeve assembly;

stopping rotation of the rotary table and securing an uphole connector end of the circulation sub to an uphole stand of the drill pipe string, where the uphole stand of the drill pipe string is secured to a subsequent circulation sub;

opening the central valve to allow the flow of fluids past the central valve within the uphole internal bore and delivering the drilling mud through the drill pipe string by way of the rig drive;

picking the drill pipe string off of the slips; and resuming the drilling of the subterranean well by rotating the uphole stand of the drill pipe string with the rig drive.

16. The method of claim 15, where the side-entry port is a normal closed port in which fluid is prevented from passing in either direction through the side-entry port, and where the method includes moving the side-entry port to an open position to provide the fluid flow path from the exterior of the sleeve assembly to the at least one check valve.

17. The method of claim 15, where each of the at least one check valves is a normal closed valve in which fluid is prevented from passing in either direction through the check valve, and where the method includes moving a check valve an open position to provide the fluid flow path through the check valve.

18. The method of claim 15, further including a ring shaped chamber circumscribing the uphole body and providing a fluid flow path from the side-entry port to the at least one check valve.

19. The method of claim 15, where the sleeve assembly includes an outer sleeve member and an inner sleeve member, the outer sleeve member having an outer port and the inner sleeve member having an inner port, and where the side-entry port includes the outer port and the inner port, and where the method further includes rotating the outer sleeve member relative to the inner sleeve member between a port open position and a port closed position, where in the port open position the outer port is in fluid communication with the inner port and in the port closed position the outer port is free of fluid communication with the inner port.

20. The method of claim 15, where the step of diverting the drilling mud to the side-entry port of the sleeve assembly includes engaging the side-entry port with a clamp, where the clamp includes:

a nozzle segment being an arc shaped member with an inner diameter profile shaped to engage the side-entry port, and a nozzle attachment extending radially outward from an outer diameter sized to engage a side-entry hose;

a band segment hinged to a band end of the nozzle segment and having a pin at a second end of the nozzle segment; and a cam assembly having an attachment member extending from a hook end of the nozzle segment, the attachment member having a hook sized to engage the pin of the band segment, and having a handle operable to rotate relative to the hook end of the nozzle segment to secure the clamp around the sleeve assembly.

21. The method of claim 20, where the side-entry hose extends from a diversion manifold to the nozzle attachment of the clamp, the side-entry hose delivering the drilling mud to the circulation sub for circulation of the drilling mud into the subterranean well.

22. The method of claim 15, further including before stopping rotation of the rotary table, locating the uphole stand in a position to be secured to the uphole connector end of the circulation sub.

23. The method of claim 15, further including after completion of the drilling of the subterranean well:

setting the drill pipe string on the slips;

diverting the drilling mud to the side-entry port of the sleeve assembly;

closing the central valve to prevent the flow of fluids past the central valve within the uphole internal bore;

removing the uphole stand from the drill pipe string;

rotating the drill pipe string, the uphole body, and the downhole body about the central axis with the rotary table, free of relative rotation between the uphole body and the downhole body, where the uphole body and the downhole body rotate independently from the sleeve assembly;

racking back the uphole stand;

stopping the rotation of the rotary table and securing the downhole stand to the rig drive;

opening the central valve and delivering the drilling mud through the drill pipe string by way of the rig drive;

picking the drill pipe string off of the slips; and pulling the downhole stand of the drill pipe string in an uphole direction out of the subterranean well with the rig drive.

24. The method of claim 23, where the step of diverting the drilling mud to the side-entry port of the sleeve assembly includes engaging the side-entry port with a clamp, where the clamp includes:

a nozzle segment being an arc shaped member with an inner diameter profile shaped to engage the side-entry port, and a nozzle attachment extending radially outward from an outer diameter sized to engage a side-entry hose;

a band segment hinged to a band end of the nozzle segment and having a pin at a second end of the nozzle segment; and a cam assembly having an attachment member extending from a hook end of the nozzle segment, the attachment member having a hook sized to engage the pin of the band segment, and having a handle operable to rotate relative to the hook end of the nozzle segment to secure the clamp around the sleeve assembly.

* * * * *